US012163425B2

(12) United States Patent
Larsen et al.

(10) Patent No.: US 12,163,425 B2
(45) Date of Patent: Dec. 10, 2024

(54) AUTOMATED GEOSTEERING BASED ON A DISTANCE TO OIL-WATER CONTACT

(71) Applicants: David Selvaag Larsen, Celle (DE); Fredrik Jonsbråten, Bryne (NO); Christian Fulda, Lower Saxony (DE)

(72) Inventors: David Selvaag Larsen, Celle (DE); Fredrik Jonsbråten, Bryne (NO); Christian Fulda, Lower Saxony (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/200,207

(22) Filed: Mar. 12, 2021

(65) Prior Publication Data

US 2021/0285297 A1 Sep. 16, 2021

Related U.S. Application Data

(60) Provisional application No. 62/989,020, filed on Mar. 13, 2020.

(51) Int. Cl.
*E21B 7/10* (2006.01)
*E21B 7/06* (2006.01)
(Continued)

(52) U.S. Cl.
CPC ..... *E21B 7/10* (2013.01); *E21B 7/06* (2013.01); *E21B 47/022* (2013.01); *E21B 47/026* (2013.01)

(58) Field of Classification Search
CPC ... E21B 23/00; E21B 7/04; E21B 7/06; E21B 7/10; E21B 47/022; E21B 47/026; E21B 47/09; E21B 47/0224; E21B 7/046
See application file for complete search history.

(56) References Cited

U.S. PATENT DOCUMENTS 6,088,294 A * 7/2000 Leggett, III ..... E21B 44/00 175/45
7,557,580 B2 7/2009 Bittar
(Continued)

FOREIGN PATENT DOCUMENTS

| | | |
|---|---|---|
| CN | 103967480 A | 8/2014 |
| EP | 1644612 B1 | 6/2008 |
| WO | 2006096456 A1 | 9/2006 |

OTHER PUBLICATIONS

Simple Linear vs Polynomial Regression _ by Andrew Hershy _ Towards Data Science—Jun. 14, 2019 (Year: 2019).*
(Continued)

*Primary Examiner* — George S Gray
(74) *Attorney, Agent, or Firm* — CANTOR COLBURN LLP

(57) ABSTRACT

A method for performing automated geosteering includes receiving, by a processing system, formation evaluation data from a bottom hole assembly disposed in a wellbore. The method further includes determining, by the processing system, position data of a formation boundary from the formation evaluation data. The method further includes extrapolating, by the processing system, the position data to generate extrapolated position data of the formation boundary. The method further includes adjusting a trajectory of the wellbore based at least in part on the extrapolated position data of the formation boundary.

20 Claims, 5 Drawing Sheets

(51) Int. Cl.
*E21B 47/022* (2012.01)
*E21B 47/026* (2006.01)

(56) References Cited

U.S. PATENT DOCUMENTS

| | | | | |
|---|---|---|---|---|
| 7,778,811 | B2 | 8/2010 | Kelfoun | |
| 9,719,341 | B2 | 8/2017 | Johnston et al. | |
| 10,024,104 | B2 | 7/2018 | Wu et al. | |
| 10,072,490 | B1 * | 9/2018 | Tchakarov | G01V 3/30 |
| 10,445,669 | B2 | 10/2019 | Wessling et al. | |
| 10,544,666 | B1 | 1/2020 | Williams | |
| 2005/0140373 | A1 * | 6/2005 | Li | G01V 3/28 702/7 |
| 2008/0208477 | A1 * | 8/2008 | Kelfoun | E21B 47/022 702/11 |
| 2009/0000823 | A1 | 1/2009 | Pirovolou | |
| 2010/0122847 | A1 * | 5/2010 | Xia | G01V 1/40 175/50 |
| 2012/0046868 | A1 * | 2/2012 | Tchakarov | E21B 7/04 702/9 |
| 2015/0267525 | A1 * | 9/2015 | May | E21B 49/00 175/45 |
| 2017/0096887 | A1 * | 4/2017 | Wilson | G01V 3/38 |
| 2017/0321545 | A1 * | 11/2017 | Wilson | G01V 3/38 |
| 2017/0342815 | A1 | 11/2017 | Hay | |
| 2018/0292563 | A1 * | 10/2018 | Zhong | G01V 3/30 |
| 2018/0334896 | A1 * | 11/2018 | Samuel | E21B 49/003 |
| 2019/0265381 | A1 * | 8/2019 | Sugiura | G01V 3/18 |
| 2019/0292898 | A1 | 9/2019 | Quattrone et al. | |

OTHER PUBLICATIONS

Alyaev et al.; "A Decision Support System for Multi-Target Geosteering"; Retrieved Online from arXiv:1903.03933v2 [cs.CE]; Sep. 20, 2019; 44 Pages.

International Search Report Issued in International Application No. PCT/US2021/022282 mailed Jun. 28, 2021; 5 Pages.

Written Opinion Issued in International Application No. PCT/US2021/022282 mailed Jun. 28, 2021; 4 Pages.

* cited by examiner

AUTOMATED GEOSTEERING BASED ON A DISTANCE TO OIL-WATER CONTACT

CROSS-REFERENCE TO RELATED APPLICATION

This application claims the benefit of U.S. Provisional Application Ser. No. 62/989,020, filed Mar. 13, 2020, the entire disclosure of which is incorporated by reference.

BACKGROUND

Embodiments described herein relate generally to downhole exploration and production efforts in the resource recovery industry and more particularly to techniques for automated geosteering based on a distance to formation boundary.

Downhole exploration and production efforts involve the deployment of a variety of sensors and tools. The sensors provide information about the downhole environment, for example, by collecting data about temperature, density, saturation, and resistivity, among many other parameters. This information can be used to control aspects of drilling and tools or systems located in the bottom hole assembly, along the drillstring, or on the surface.

SUMMARY

Embodiments of the present invention are directed to performing automated geosteering based on a distance to oil-water contact.

A non-limiting example method for performing automated geosteering includes receiving, by a processing system, formation evaluation data from a bottom hole assembly disposed in a wellbore. The method further includes determining, by the processing system, position data of a formation boundary from the formation evaluation data. The method further includes extrapolating, by the processing system, the position data to generate extrapolated position data of the formation boundary. The method further includes adjusting a trajectory of the wellbore based at least in part on the extrapolated position data of the formation boundary.

A non-limiting example system for preforming automated geosteering of a wellbore includes a bottom hole assembly disposed in the wellbore, and a processing system for executing computer readable instructions, the computer readable instructions controlling the processing system to perform operations. The operations include receiving, by the processing system, formation evaluation data from the bottom hole assembly disposed in the wellbore. The operations further include determining, by the processing system, position data of a formation boundary from the formation evaluation data. The operations further include extrapolating, by the processing system, the position data to generate extrapolated position data of the formation boundary. The operations further include adjusting a trajectory of the wellbore based at least in part on the extrapolated position data of the formation boundary.

Other embodiments of the present invention implement features of the above-described method in computer systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

Referring now to the drawings wherein like elements are numbered alike in the several figures.

DETAILED DESCRIPTION

Modern bottom hole assemblies (BHAs) are composed of several distributed components, such as sensors and tools, with each component performing data acquisition and/or processing of a special purpose. An example of one type of data acquired can include electromagnetic data.

Figure 1:
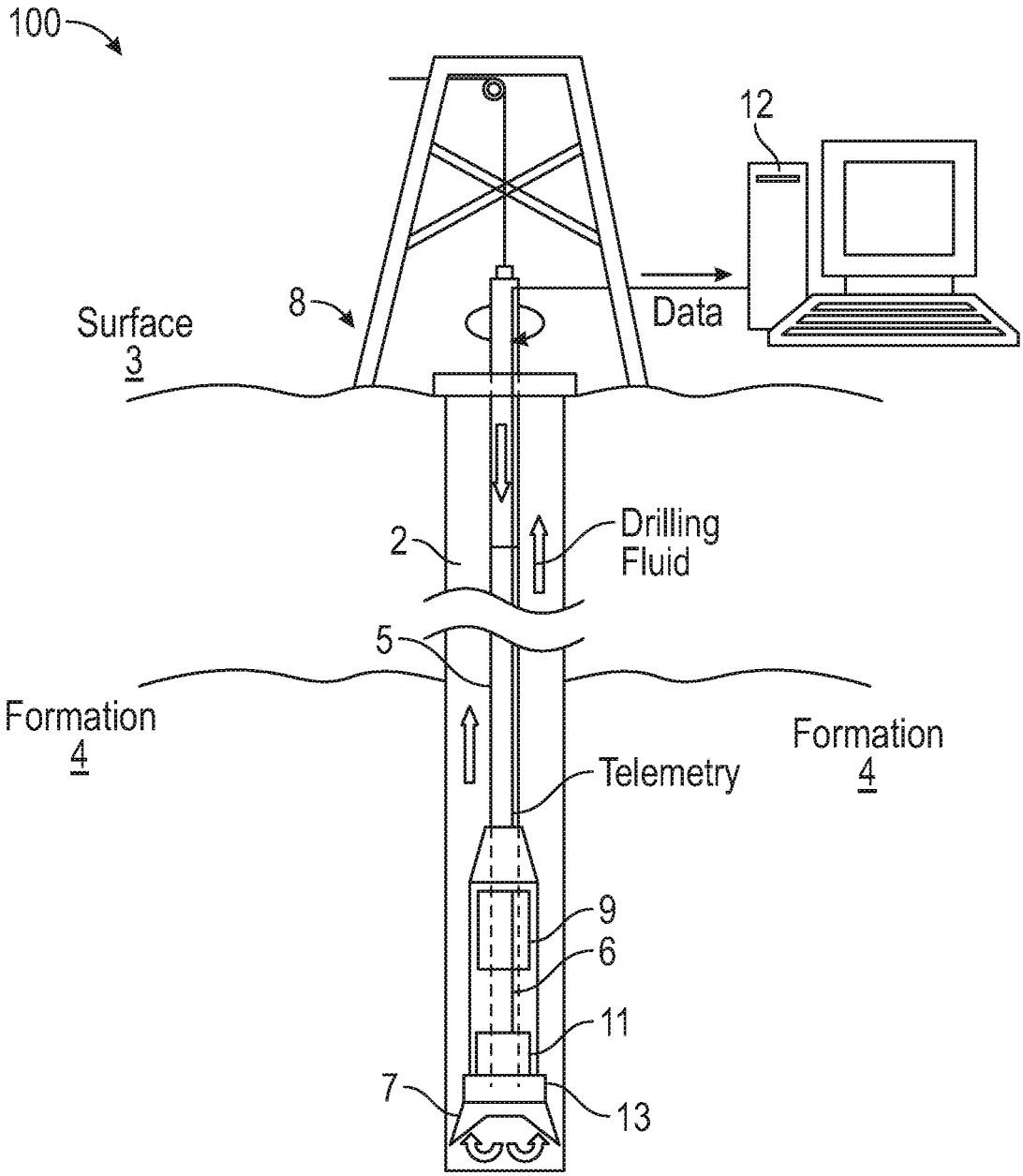
FIG. 1 depicts a cross-sectional view of a wellbore operation system according to one or more embodiments described herein.

Wellbores are drilled into a subsurface to produce hydrocarbons and for other purposes. In particular, FIG. 1 depicts a cross-sectional view of a wellbore operation system 100, according to aspects of the present disclosure. In traditional wellbore operations, logging-while-drilling (LWD) measurements are conducted during a drilling operation to determine formation rock and fluid properties of a formation 4. Those properties are then used for various purposes such as estimating reserves from saturation logs, defining completion setups, etc. as described herein.

The system and arrangement shown in FIG. 1 is one example to illustrate the downhole environment. While the system can operate in any subsurface environment, FIG. 1 shows a carrier 5 disposed in a borehole 2 penetrating the formation 4. The carrier 5 is disposed in the borehole 2 at a distal end of the borehole 2, as shown in FIG. 1.

As shown in FIG. 1, the carrier 5 is a drill string that includes a bottom hole assembly (BHA) 13. The BHA 13 is a part of the operation system 100 and includes drill collars, stabilizers, reamers, and the like, and the drill bit 7. In examples, the drill bit 7 is disposed at a forward end of the BHA 13. The BHA 13 also includes sensors (e.g., measurement tools 11) and electronic components (e.g., downhole electronic components 9). The measurements collected by the measurement tools 11 can include measurements related to drill string operations, for example. BHA 13 also includes a steering tool configured to steer BHA 13 and drill bit 7 into a desired direction. The steering tool may receive steering commands based on which it creates steering forces to push or point drill bit 7 into the desired direction. Operation system 100 is configured to conduct drilling operations such as rotating the drill string and, thus, the drill bit 7. A drilling rig 8 also pumps drilling fluid through the drill string 5 in order to lubricate the drill bit 7 and flush cuttings from the borehole 2. The measurement tools 11 and downhole electronic components 9 are configured to perform one or more types of measurements in an embodiment known as logging-while-drilling (LWD) or measurement-while-drilling (MWD) according to one or more embodiments described herein.

Raw data is collected by the measurement tools 11 and transmitted to the downhole electronic components 9 for processing. The data can be transmitted between the measurement tools 11 and the downhole electronic components 9 by an electrical conduit 6, such as a wire (e.g. a powerline) or a wireless link, which transmits power and/or data between the measurement tools 11 and the downhole electronic components 9. Power is generated downhole by a turbine-generation combination (not shown), and communication to the surface 3 (e.g., to a processing system 12) is cable-less (e.g., using mud pulse telemetry, electromagnetic telemetry, etc.) and/or cable-bound (e.g., using a cable to the processing system 12, e.g. by wired pipes). The data processed by the downhole electronic components 9 can then be telemetered to the surface 3 for additional processing or display by the processing system 12.

Drilling control signals can be generated by the processing system 12 (e.g., based on the raw data collected by the measurement tools 11) and conveyed downhole or can be generated within the downhole electronic components 9 or by a combination of the two according to embodiments of the present disclosure. The downhole electronic components 9 and the processing system 12 can each include one or more processors and one or more memory devices. In alternate embodiments, computing resources such as the downhole electronic components 9, sensors, and other tools can be located along the carrier 5 rather than being located in the BHA 13, for example. The borehole 2 can be vertical as shown or can be in other orientations/arrangements (see, e.g., FIG. 3A, FIG. 3B).

Figure 2:
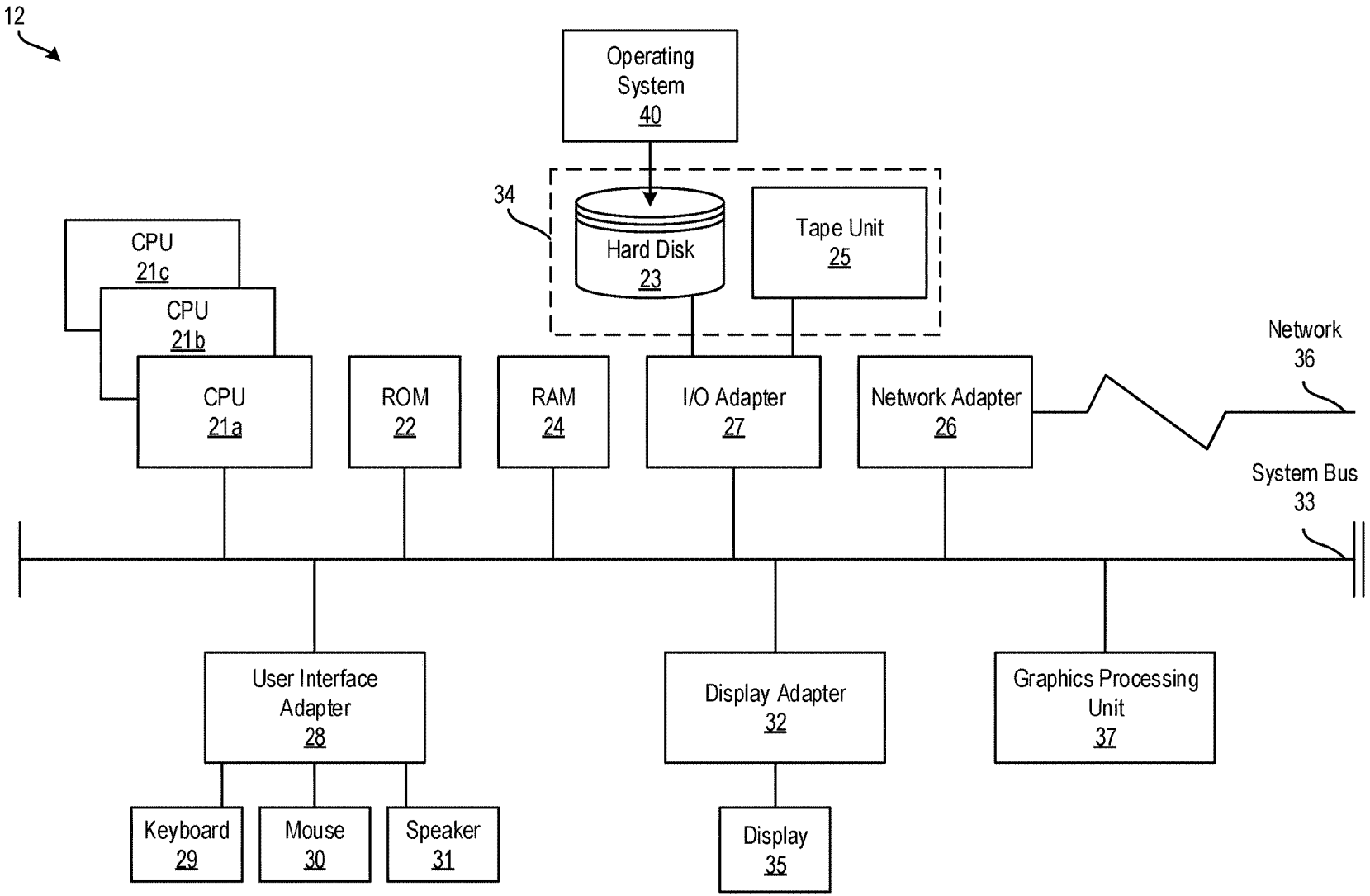
FIG. 2 depicts a block diagram of the processing system of FIG. 1, which can be used for implementing the present techniques herein according to one or more embodiments described herein.

It is understood that embodiments of the present disclosure are capable of being implemented in conjunction with any other suitable type of computing environment now known or later developed. For example, FIG. 2 depicts a block diagram of the processing system 12 of FIG. 1, which can be used for implementing the techniques described herein. In examples, processing system 12 has one or more central processing units 21*a*, 21*b*, 21*c*, etc. (collectively or generically referred to as processor(s) 21 and/or as processing device(s) 21). In aspects of the present disclosure, each processor 21 can include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and can include a basic input/output system (BIOS), which controls certain basic functions of processing system 12.

Further illustrated are an input/output (I/O) adapter 27 and a network adapter 26 coupled to system bus 33. I/O adapter 27 can be a small computer system interface (SCSI) adapter that communicates with a memory, such as a hard disk 23 and/or a tape storage drive 25 or any other similar component. I/O adapter 27 and memory, such as hard disk 23 and tape storage device 25 are collectively referred to herein as mass storage 34. Operating system 40 for execution on the processing system 12 can be stored in mass storage 34. The network adapter 26 interconnects system bus 33 with an outside network 36 enabling processing system 12 to communicate with other systems.

A display (e.g., a display monitor) 35 is connected to system bus 33 by display adaptor 32, which can include a graphics adapter to improve the performance of graphics intensive applications and a video controller. In one aspect of the present disclosure, adapters 26, 27, and/or 32 can be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 can be interconnected to system bus 33 via user interface adapter 28, which can include, for example, a Super I/O chip integrating multiple device adapters into a single integrated circuit.

In some aspects of the present disclosure, processing system 12 includes a graphics processing unit 37. Graphics processing unit 37 is a specialized electronic circuit designed to manipulate and alter memory to accelerate the creation of images in a frame buffer intended for output to a display. In general, graphics processing unit 37 is very efficient at manipulating computer graphics and image processing and has a highly parallel structure that makes it more effective than general-purpose CPUs for algorithms where processing of large blocks of data is done in parallel.

Thus, as configured herein, processing system 12 includes processing capability in the form of processors 21, storage capability including system memory (e.g., RAM 24 and mass storage 34), input means such as keyboard 29 and mouse 30, and output capability including speaker 31 and display 35. In some aspects of the present disclosure, a portion of system memory (e.g., RAM 24 and mass storage 34) collectively store an operating system to coordinate the functions of the various components shown in processing system 12.

According to examples described herein, techniques for automated geosteering are provided. During geosteering, it may be desirable to maintain a certain distance between the BHA and a distinct formation feature, such as a formation boundary within formation 4, e.g. the boundary between two different formations (e.g. sand and shale), an oil-water contact, or a fluid-gas contact within the formation. A boundary between two different formations (e.g. sand and shale) is a surface in the formation 4 where the two formations come into contact. Similarly, an oil-water contact or a fluid-gas contact is a surface in the formation 4 where oil and water or fluid and gas come into contact in a formation or where oil saturation, water saturation, and/or gas saturation have a distinct value, such as a pre-defined value. Typically, the oil-water contact denotes a surface having oil above and water below and the fluid-gas contact denotes a surface having gas above and fluid below. Formation features like formation boundaries (e.g. boundaries between two different formations, oil-water contacts, or fluid-gas contacts) can vary in space and may not be plain areas.

In order to achieve optimal hydrocarbon recovery from a hydrocarbon reservoir, it may be desirable to drill a wellbore a desired distance away from a formation boundary. Accordingly, the techniques for automated geosteering described herein provide for steering a bottom hole assembly based on running inversions on downhole measurements (data) to achieve and maintain a desired/optimal distance between at least a part of the BHA (e.g. the drill bit) and a projected formation boundary. A desired well trajectory can be continuously updated based on the downhole measurements.

In particular, the present techniques utilize downhole measurements (data), for example formation evaluation measurements (data), such as electromagnetic, acoustic, or nuclear data/measurements (data) to quantify an actual distance between the BHA and the formation boundary. This data is then used to steer the BHA and associated drill bit to an optimal placement (e.g. for oil production) relative to the formation boundary. This is performed by determining target inclinations to achieve optimal true vertical depth (TVD) and inclination placement of the BHA, which is based on a predicted dip (based on prior measured data points) determined using regression techniques, dogleg severity, and optimal TVD placement.

Figure 3A:
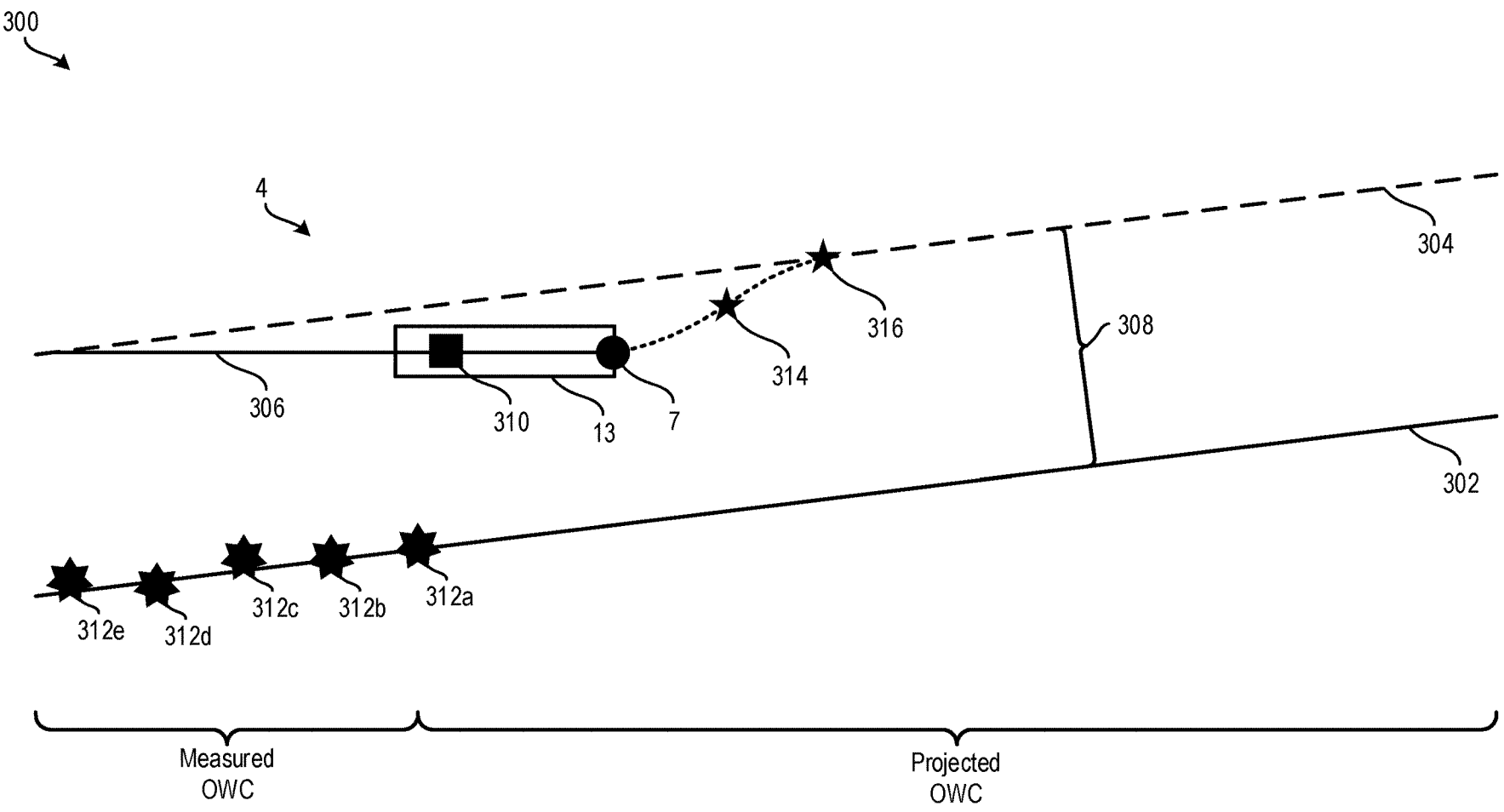
FIG. 3A depicts a cross-sectional view of a wellbore operation system according to one or more embodiments described herein.

FIG. 3A depicts a cross-sectional view of a subsurface 300 according to one or more embodiments described herein. The subsurface 300 includes an actual path 306 that the BHA 13 is traveling through the formation 4. It is desirable for the BHA 13 to remain a desired distance 308 away from a formation boundary which is in this example an oil-water contact area 302 to improve hydrocarbon recovery, for example (in the cross sectional view of FIG. 3A, the oil-water contact area 302 appears as an oil-water contact line). Accordingly, it is desirable for the BHA 13 to travel along a desired well trajectory or intended path 304, which is the desired distance 308 away from the oil-water contact area 302. The distance of BHA 13 to the oil-water contact area 302 can be determined, for example, using electromagnetic, acoustic, or nuclear data collected by the BHA 13 or by another suitable device.

As shown in FIG. 3A, the BHA 13 includes a measurement point 310 at which the data are collected/measured. As one such example, the measurement point 310 coincides with a location of a measurement tool (e.g., one or more of the measurement tools 11, a sensor on one or more of the measurement tools 11, a location on one or more of the measurement tools 11 relative to a receiver and/or a transmitter of a receiver and a transmitter included in one or more of the measurement tools 11). The measurement tool collects, at the measurement point 310, data (e.g. electromagnetic, acoustic, or nuclear data) about the oil-water contact area 302 (e.g. about the location or distance of the oil-water contact area relative to the position of the measurement point 310) at points prior to the current position of the measurement tool. For example, the measurement tool 11, at the measurement point 310, collects data at data points (that is points or locations in space at which the data was collected) to identify or determine distance to location points 312*a*, 312*b*, 312*c*, 312*d*, 312*e*, where the location point 312*a* is the location point or location of the oil-water contact area in space for which the newest data was collected (i.e., data from most recently collected data point) and the location point 312*e* is the location point or location of the oil-water contact area in space for which the oldest data was collected.

Location points 312*a*, 312*b*, 312*c*, 312*d*, 312*e* include data based on which the distance of the BHA 13 to the oil-water contact area 302 at the time each of the location points 312*a*-312*e* were acquired, can be determined. To determine distances of the BHA 13 to the oil-water contact area 302 at the time each of the location points 312*a*-312*e* were acquired, a simple transform may be used. In another embodiment, to determine distances of the BHA 13 to the oil-water contact area 302 at the time each of the location points 312*a*-312*e* were acquired, an inversion may be performed. In the inversion, a formation may by simulated in a computer model. The simulated formation may be characterized by two or more subregions that may be characterized by a parameter such as a resistivities, conductivities, permittivities (for an EM measurement) or impedances, densities, (for an acoustic measurement), or oil saturations, water saturations, lithologies, etc. The two or more subregions in the simulated formations may create a formation boundary between them that is characterized by the parameters of the adjacent subregions and the location of the formation boundary (such as a distance to a measurement tool or another distinct point in the formation, e.g. location of drilling rig 8, etc.). Finally, the one or more locations of a hypothetical measurement tool during one or more measurements is simulated in the computer model. With these assumptions, one or more simulated measurements can be calculated using methods known in the art. The one or more simulated measurements can then be compared with one or more actual measurements of BHA 13 and parameters—including the location of the formation boundary relative to the one or more locations of the hypothetical measurement tool during the one or more measurements—may be varied until the simulated measurement and the actual measurement are close enough (such as the difference or ratio between simulated and actual measurement is in a predefined range or below a predefined value. When simulated and actual measurement are close enough, the parameters that were used to create the simulated measurement are then assumed to be determined.

As an example, steering of the BHA 13 is performed using results of the inversions on the data, and that information is projected ahead of the drill bit for determining what steering instructions are useful in order to bring the actual path 306 that the BHA 13 is traveling (i.e., wellpath) parallel to, and at the desired distance from, the oil-water contact area 302.

A current wellpath is projected ahead to a drill bit position using inclination data and/or azimuth. As one such example, formation evaluation data is loaded, and directional survey data, such as inclination data and/or azimuth data is acquired. Survey data (e.g. a nearbit inclination log) may be filtered to remove any outlier points by applying a filter, such as a changerate filter, to the survey data. The changerate filter can filter outlier points from the nearbit inclination log that fall outside a predetermined rate of change of the inclination angle of the drill bit. Azimuth/inclination (e.g. a calculated or modeled azimuth/inclination or an azimuth/inclination that was measured or taken on one or more previous survey stations) is assumed, and a survey may be calculated based on the assumed azimuth/inclination by using a formula, such as a minimum curvature formula, for one or more samples from the azimuth/inclination (e.g. nearbit inclination) or formation evaluation data. The minimum curvature method assumes a relationship between coordinate differences (such as differences of horizontal coordinates, e.g. horizontal coordinates with respect to east and north, and a vertical coordinate, e.g. TVD) of two points in space and survey data (such as azimuth, inclination, and measured depth) at these two points in space. For example, if azimuth, inclination, and measured depth at surveys I and II is A1, I1, MD1 and A2, I2, MD2, respectively, the coordinate differences at survey I and II can be calculated by $$N2-N1=(MD2-MD1)/2\times[\sin I1 \cos A1+\sin I2 \cos A2]\times RF$$

$$E2-E1=(MD2-MD1)/2\times[\sin I1 \sin A1+\sin I2 \sin A2]\times RF$$

$$TVD2-TVD1=[\cos I1+\cos I2]\times RF$$

With: RF=2 tan(beta/2)/beta and beta=a cos(cos(I2−I1)−sin I1×sin I2×(1−cos(A2−A1).

N2, E2, TVD2, and N1, Ea, TVD1 are horizontal coordinate with respect to north, horizontal coordinate with respect to east, and TVD at surveys II and I, respectively. These formulas allow to calculate coordinate differences of two points in space form survey data at these two points in space and vice versa.

In some cases, an average of two or more samples may be used as the azimuth/inclination/formation evaluation data. This approach is more robust in the case of poor data quality. In examples, this approach can be performed iteratively as the BHA 13 progresses along the actual path 306. Each iteration can begin from a previously taken survey, thus the distance of the well azimuth assumption is minimized.

In some cases, when determining how to adjust the trajectory of the BHA 13, an exception can occur. An exception occurs when an unexpected event is encountered, such as when a value is outside an acceptable range. When an exception occurs, an exception flag (i.e., an error flag) can be set. One example of such an exception of an unexpected event occurs when a rate of change of a slope (e.g., an angle of the formation boundary at a point relative to horizontal) of the formation boundary (i.e., oil-water contact) falls outside an expected range. For example, an exception occurs if the difference in position, TVD, or distance to the actual path 306 of the formation boundary calculated at a previous location (e.g., location point 312*b*) and the difference in position, TVD, or distance to the actual path 306 of the formation boundary calculated at current location (e.g., a current location for the measurement point 310) divided by the distance (e.g. the difference in measured depth) of the previous and the current location is above a threshold, for example a predefined threshold. Similarly, an exception may occur if the difference between a slope of the formation boundary calculated at a previous location (e.g., location point 312*b*) and a slope of the formation boundary calculated at the current location (e.g., a current location for the measurement point 310) divided by the distance (e.g. the difference in measured depth) of the previous and the current location is above a threshold, for example a predefined threshold. In such cases, the inversion result may be ignored. Another such exception occurs when a curve is misfit to the formation boundary (i.e., when a curve fit to the formation boundary is outside an acceptable threshold, such as a predefined threshold. Yet another exception occurs when a gamma ray value (which may be measured by the measurement tools 11 of the BHA 13) is above a threshold, such as a predefined threshold. In the case of an exception being detected, an error flag may be set. The error flag can serve as an indicator to an operator that an exception has occurred. Yet another such exception occurs when a rate of penetration of the BHA 13 goes down and the weight on the drill bit goes up. In such cases, the well is likely drilling a hard formation, such as a calcite stringer, which has low porosity and thus little fluids in it, resulting in a high measured resistivity. Upon the occurrence of one or more of these (or other) exceptions, the corresponding measurements, calculations, or inversion results may be ignored. Another example of an exception occurs when the projected wellpath is shallower than a defined formation boundary. In such a case, the projected wellpath may be adjusted down to a minimum total vertical depth that is acceptable/allowable. Another example of an exception occurs when a separation between a density curve and a neutron porosity curve is greater than a predefined limit when plotted on a standard scale. In such a case, the TVD for the estimated formation boundary contact may be adjusted to the TVD of the actual wellpath.

A projected wellpath ahead of the drill bit is projected to include a projected point 316 that is a target to which the BHA 13 is to be steered (for example, a target point or setpoint for a manual, automatic, or semi-automatic control process to steer BHA 13, e.g. a controlled closed loop system to steer BHA 13). In one or more examples, an average azimuth/inclination/formation evaluation data value for the last "n" location points (e.g., the location points 312*a*-312*e*) is calculated as described herein.

With the projected oil-water contact area 302, a projected point (i.e., target point or setpoint) 316 is determined that has a desired distance from the projected oil-water contact area. To do this, a most recent location point (e.g., the location point 312*a*) is considered. However, in some examples, one or more of the prior location points 312*b*-312*d* are also considered, for example by working from the most recent location point back in time. Taking the determined of one or more of the location points 312*a*-312*e*, the location of the oil-water contact area 302 may be extrapolated to generate extrapolated position data by any known extrapolation technique, such as a linear regression technique. Such an extrapolation technique enables determining a curve parameter of the projected oil-water contact area, such as a slope and an offset.

The BHA 13 is then steered, such as by adjusting its trajectory, towards the projected point 316. In some examples, an intermediate point 314 is determined similarly, and multiple intermediate points can exist between the current location of the drill bit 7 and the projected point 316. The path between any two of those points (e.g., between the drill bit 7 and the intermediate point 314, between two intermediate points, between the intermediate point 314 and the projected point 316) can have a different inclination than other areas of the path of the BHA 13. This enables the BHA 13 to be steered onto the intended path 304 without overshoot it.

Figure 3B:
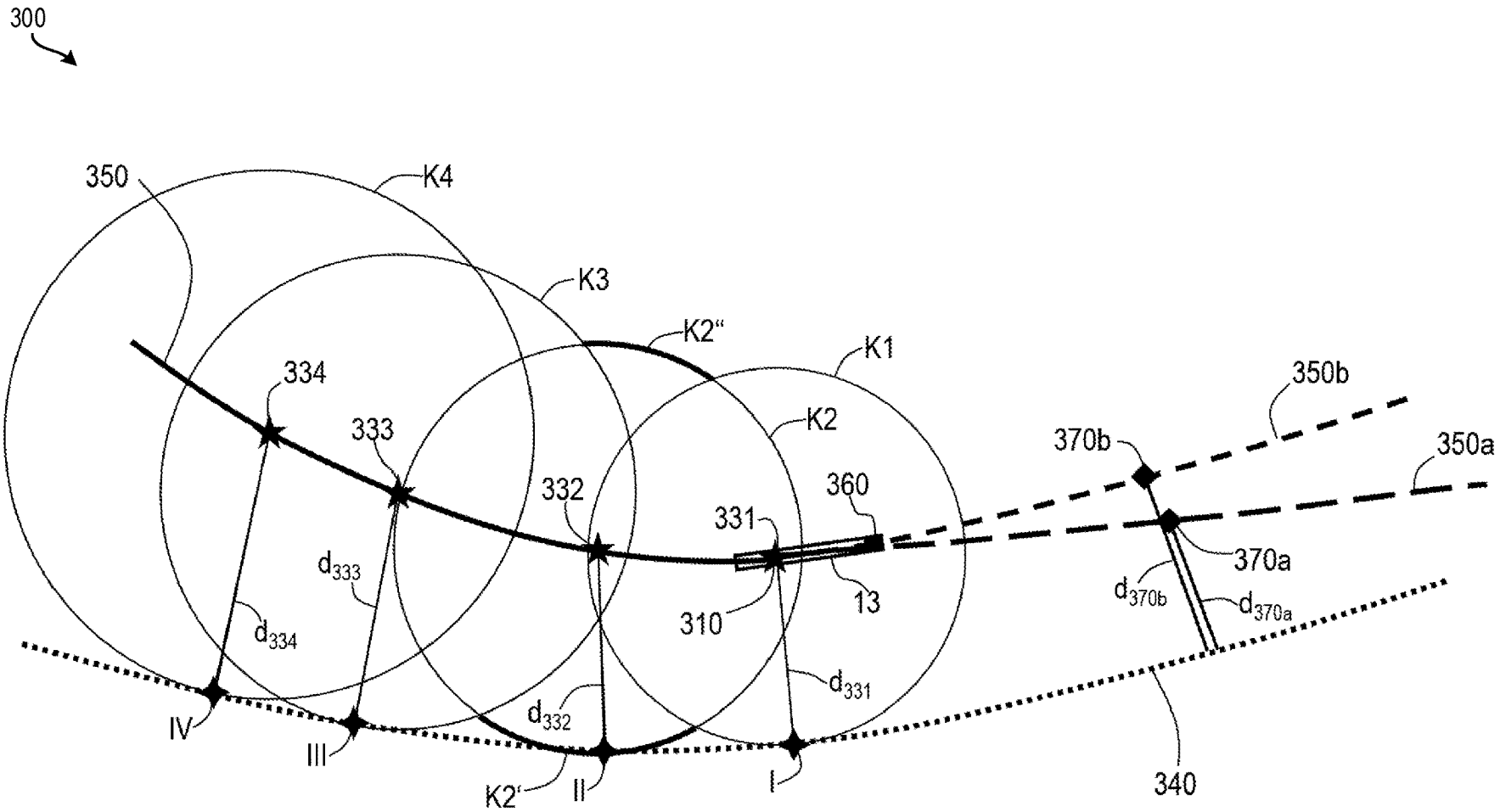
FIG. 3B depicts another cross-sectional view of a wellbore operation system according to one or more embodiments described herein.

Turning now to FIG. 3B, aspects of the disclosed methods are shown in more detail. Similar to FIG. 3A, FIG. 3B depicts a cross-sectional view of a subsurface 300 according to one or more embodiments described herein. A borehole is drilled into subsurface 300 along an actual path (or actual well trajectory) 350 by BHA 13 that includes drill bit 360. Along the actual path 350, BHA 13 approaches a formation boundary 340 that may be at least partially a plain area or may be a curved surface. Setpoint 370*a* is defined in space to steer BHA 13 along an intended path (or planned well trajectory) 350*a*. BHA 13 includes a measurement point 310 at which data are collected/measured. As one such example, the measurement point 310 coincides with a location of a measurement tool in BHA 13 (e.g., one or more of measurement tools, a sensor on one or more of the measurement tools, a location on one or more of the measurement tools relative to a receiver and/or a transmitter of a receiver and a transmitter included in one or more of the measurement tools). The measurement tool collects, at the measurement point 310, data (e.g. electromagnetic, acoustic, or nuclear data) about the formation boundary (e.g. data about the location or distance of the formation boundary relative to the position of the measurement point 310) at points prior to the current position of the measurement tool. For example, the measurement tool, at the measurement point 310, collects data at data points 331, 332, 333, and 334 (that is points or locations in space at which the data was collected), where the data point 331 is the point or location in space at which the newest data was collected (i.e., a most recently collected data point) and the data point 334 is the point or location in space at which the oldest data was collected. In aspects, the measurement tool measures or collects data that can be used to determine distances d331, d332, d333, and d334 from respective data points 331, 332, 333, and 334 to respective location points I, II, III, and IV as shown by FIG. 3B.

Data points 331, 332, 333, and 334 are associated with respective measurement times $t_{331}$, $t_{332}$, $t_{333}$, and $t_{334}$ (not shown) which are indicative of the time when the data at the data points is collected. Similarly, data points 331, 332, 333, and 334 are associated with respective measured depths $D_{331}$, $D_{332}$, $D_{333}$, and $D_{334}$ (not shown) at which the data is collected ("measured depth" is an industry term for distance from a reference point, such as the earth's surface, along the actual well trajectory 350). In addition, data points 331, 332, 333, and 334 may be associated with directional data of BHA 13, such as azimuth or inclination of BHA 13. For example, data point 331 may be associated with azimuth and inclination of BHA 13 at the location of data point 331, data point 332 may be associated with azimuth and inclination of BHA 13 at the location of data point 332, etc. Directional data of BHA 13 may be collected by directional sensors in BHA 13, such as magnetometers, gravitometers, accelerometers, and/or gyroscopes. Directional data associated with data points 331, 332, 333, and 334 may be measured at the location of data points 331, 332, 333, and 334 or may be derived from directional data that is measured at locations different from data points 331, 332, 333, and 334 (for example, taken, interpolated, or extrapolated from directional data that is measured at locations different from data points 331, 332, 333, and 334). From measured depths $D_{331}$, $D_{332}$, $D_{333}$, and $D_{334}$ and associated directional data, coordinates (e.g. 3-dimensional coordinates with respect to an origin, such as drilling rig 8, or 2-dimensional coordinates in a cross section as shown in FIGS. 3A, 3B with respect to an origin) and/or true vertical depths (TVD) of respective data points 331, 332, 333, and 334 may be derived as known in the art. With the coordinates/TVDs of data points 331, 332, 333, and 334, and the distances $d_{331}$-$d_{334}$ and/or the data collected at data points 331, 332, 333, and 334, coordinates/TVDs of location points I, II, III, and IV of formation boundary can be derived as it is further disclosed herein.

FIG. 3B demonstrates that distances $d_{331}$-$d_{334}$ alone are not sufficient to construct position of location points I-IV of formation boundary 340 as there is uncertainty for each data point 331-334 in which direction relative to BHA 13 formation boundary 340 was detected. This is indicated by spheres K1-K4 with respective data points 331-334 as center points and respective distances $d_{331}$-$d_{334}$ as radiuses. For example, K1 has data point 331 as center point and distance $d_{331}$ as radius, K2 has data point 332 as center point and distance $d_{332}$ as radius, etc. If only distance d332 was known, location point II of formation boundary 340 could be at any point of sphere K2. In other words, distance of data point 332 to formation boundary 340 is measured along a line that is not perpendicular to actual well trajectory 350. However, taking two or more data points into account for the construction of location point II of formation boundary 340, can help to reduce the uncertainty significantly. For example, if $d_{331}$, $d_{332}$, $d_{333}$, and $d_{334}$ is known, it can be concluded that the location of formation boundary can not be at any point of sphere K2 but can only fall on sphere segments K2' and K2" which do not fall into one or more of the corresponding spheres of the other data points (e.g. spheres K1, K3, and/or K4 of respective data points 331, 333, and/or 334). This helps to determine as to where location point II of formation boundary 340 has to be located. In other words, a point in space that is identified from a data point as a location point of formation boundary 340 cannot be closer to any other data point then the respective distance of the other data point to formation boundary 340. Consequently, formation boundary 340 is constructed from a data point in a way to be at a measured distance from the data point and at the same time not below a measured distance from another data point.

Alternatively, or in addition, other information or criteria may be used to construct formation boundary 340 from one or more data points 331, . . . , 334. For example, formation boundary 340 may be constructed by applying a minimum curvature criterion to the constructed formation boundary 340. For example, out of the sphere segments K2' and K2" only those points may be chosen to construct formation boundary 340 that lead to a minimum curvature of constructed formation boundary 340. In addition, data collected at data points 331, . . . , 334 may include directional data that is indicative of the direction (e.g. toolface direction) relative to BHA 13 in which formation boundary 340 is located. One example of such data that includes directional data are images (e.g. images around the measurement tool or images parallel to the measurement tool). For example, if location point II is located at either sphere segment K2' or K2", directional data can be used to determine either of these sphere segments can be eliminated (for example, by indicating that formation boundary is located "below" BHA 13 and not "above" BHA 13.

In one embodiment, position data, such as distances d331, d332, d333, and d334 and/or coordinates/locations/TVDs of location points I-IV may be determined by an inversion similar to the inversion that is described with respect to FIG. 3A. An inversion can be done for each data point 331, . . . , 334, separately (single-point inversion). Alternatively, the inversion may include more than one data points to determine coordinates/locations/TVDs of location points and/or distances to location points for each data point (multi-point inversion). For example, to determine the coordinates/location/TVD of location point II or the distance d332 between data point 332 and location point II, the data measured at data point 332 as well as the data measured at data points 333 and/or 331 can be used for the inversion. Typically, a multi-point inversion leads to higher confidence in inversion results as more input data is used for the inversion. Inversions may also include various data measured at one data point. For example, BHA 13 may include one or more measurement tools for electromagnetic measurements that utilize various operating frequencies and/or various transmitter-receiver spacings. Similarly, BHA 13 may include one or more measurement tools for acoustic measurements that utilize at least one of various operating frequencies, various transmitter-receiver spacings, and various excitation modi. And BHA 13 may also include measurement tools for more than one physical characteristics. For example, BHA 13 may include a measurement tool for an electromagnetic measurement and a measurement tool for an acoustic measurement. Various combinations of different physical characteristics, operating frequency, transmitter-receiver spacing, and/or excitation modi may be used as input data for the inversion (single-point inversion or multi-point inversion).

Figure 4:
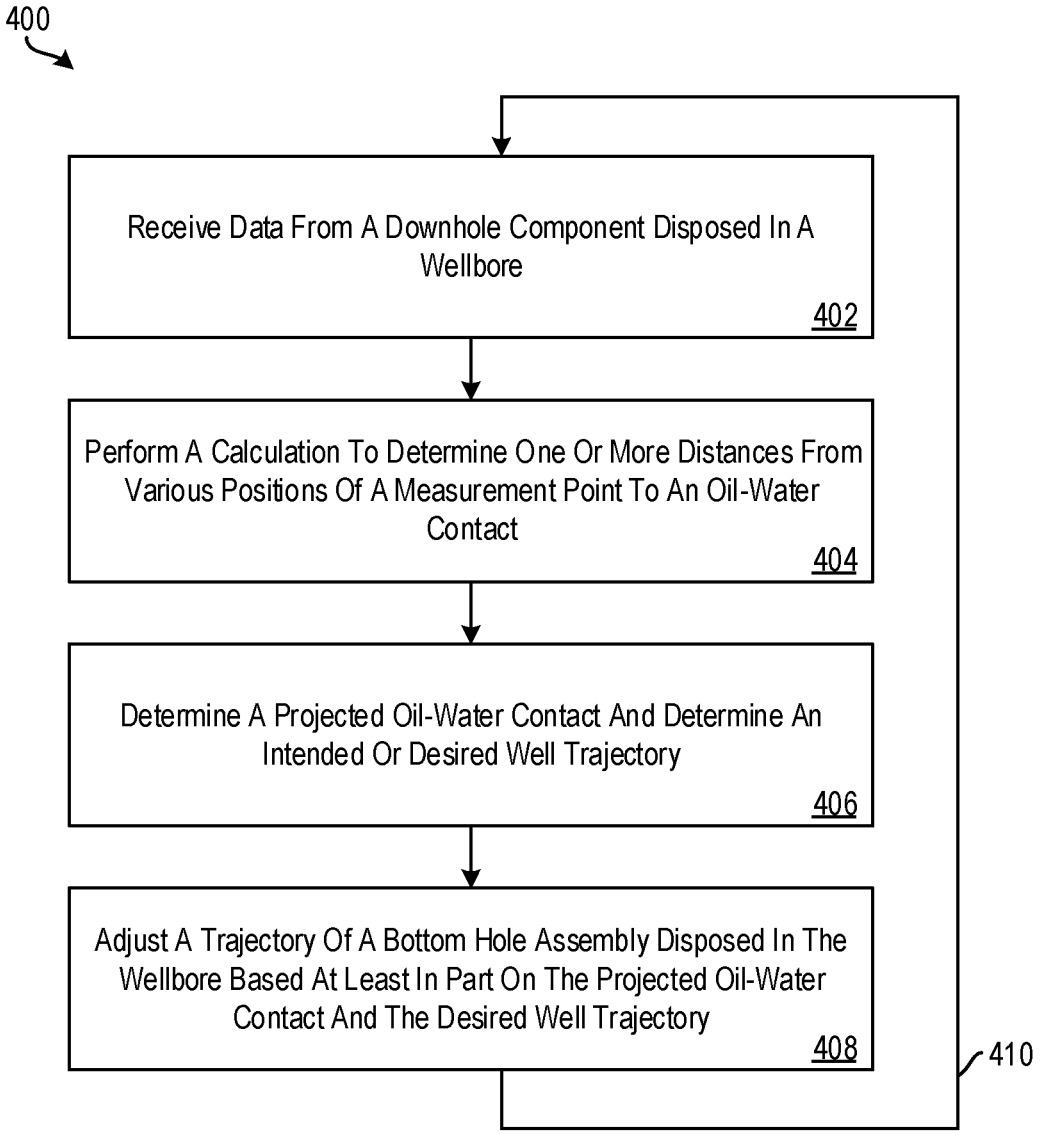
FIG. 4 depicts a flow diagram of a method for performing automated geosteering according to one or more embodiments described herein.

As discussed herein, coordinates/locations/TVDs of or distances to location points I-IV in space can be derived from measurements at data points 331, . . . 334. Coordinates/locations/TVDs of or distances to location points I-IV may then be extrapolated, for example extrapolated in a direction, such as in the direction parallel to the planned well trajectory 350*a*, to create an extrapolated formation boundary 340. A predefined number of location points may be used to create the extrapolated formation boundary 340. For example, 5, 10, or 20 location points may be used to create the extrapolated formation boundary 340 or all location points for which coordinates/locations/TVDs or distances were determined within a certain time interval, such as within the last 20 seconds, the last 60 seconds, or the last 180 seconds. Extrapolation methods for a 2D curve or a 3D surface may be applied such as a fit. For example, a fit, such as a polynomial fit or a regression, may be applied to location points I-IV that leads to an analytical equation or formula (e.g. a polynomial) or algorithm (e.g. a computer algorithm) that allows to calculate coordinates/locations/TVDs of or distances to location points I-IV in an exact or in an approximate way. The parameters of the equation or formula, such as the constants in the polynomial are then the result of the fit that can be used to calculate the position data of formation boundary 340 at coordinates/locations/TVDs different from coordinates/locations/TVDs of location points I-IV. Alternatively or in addition, a distance from any point, for example a point on the planned well trajectory 350*a* or the drill bit to formation boundary 340 can be determined by using the fit (e.g. a distance $d_{370a}$ from setpoint 370*a*). The distance from a point of the planned well trajectory 350*a* can be compared to a desired distance $d_{370b}$, such as a predefined distance threshold. Accordingly, well trajectory 350*a* can be adjusted to adjusted well trajectory (e.g. by adjusting setpoint 370*a* to adjusted setpoint 370*b*) to ensure that the distance from one or more points of the adjusted well trajectory 350*b* to formation boundary 340 is within a desired range, e.g. larger than a predefined distance threshold or between a first predefined distance threshold and a second predefined distance threshold. In a similar way, by using the fit of formation boundary 340, directional information of the formation boundary 340 can be derived from that fit, such as information about inclination and/or azimuth of formation boundary 340 (e.g. inclination/azimuth along or parallel to planned well trajectory 350*a* or inclination/azimuth along the gradient of the formation boundary 340). This information can be used to adjust inclination/azimuth of the planned well trajectory 350*a* to adjusted well trajectory 350*b* with inclination/azimuth that ensures that distance of adjusted well trajectory 350*b* to formation boundary 340 is within a desired range. Adjusted well trajectory 350*b* may take constraints into consideration, e.g. dogleg severity constraints. For example, a minimum curvature scheme may be applied to define adjusted well trajectory 350*b*. In addition, calculated adjusted well trajectory 350*b* may be checked if constraints, such as dogleg severity constraints, are met. If this is not the case, adjusted well trajectory 350*b* and/or adjusted setpoint 370*b* may be re-adjusted, for example re-adjusted by choosing an alternative setpoint at a larger distance from drill bit 360 than setpoint 370*b*. As soon as one or more new data points are acquired or received, the process may re-start to re-adjust well trajectory 350*b* and/or inclination/azimuth of well trajectory 350*b*. From adjusted well trajectory 350*b* or adjusted inclination/azimuth of well trajectory 350*b*, steering commands may be derived that are transmitted to the steering tool to steer BHA 13 including drill bit 7 into the direction of adjusted will trajectory 350*b*. The process may run fully automatic without interaction with a human operator or semi-automatic (e.g. with some supervision from a human operator). FIG. 4 depicts a flow diagram of a method 400 for performing geosteering, such as automated geosteering, according to one or more embodiments described herein. The method 400 can be performed by any suitable processing system downhole or on surface (e.g., the processing system 12 or downhole electronic components 9), any suitable processing device (e.g., one of the processors 21), and/or combinations thereof or another suitable system or device.

At block 402, the processing system 12 and/or downhole electronic components 9 receives data, such as electromagnetic (EM) data, from a downhole component disposed in a wellbore. In some examples, the received data is filtered, to remove incorrect data points. For example, such incorrect data points could represent noise or other interference that is not accurate. In some examples, data falling outside of a range (e.g., above a high threshold or below a low threshold) is removed.

At block 404, the processing system 12 and/or downhole electronic components 9 performs a calculation, such as an inversion of the data (which could be, for example, filtered data) to determine one or more distances from various positions of measurement point 310 to an oil-water contact. While FIG. 4 is discussed with respect to steering along an oil-water contact, it should be appreciated that the same methods are also applicable to steer along a different formation boundary, such as a boundary between a sand layer and a shale layer, or a fluid-gas contact. The calculation may include defining one or more layer parameters (e.g. resistivities) of one or more layers (e.g. water layers) and/or restricting one or more more layer parameters of one or more layers to a predefined threshold value, such as a predefined threshold resistivity.

At block 406, once the one or more distances of the oil-water contact from various positions of measurement point 310 has been quantified, the processing system 12 and/or downhole electronic components 9 determines a projected oil-water contact (e.g. oil-water contact area 302 in FIG. 3A, formation boundary 340 in FIG. 3B). From the projected oil-water contact, an intended or desired well trajectory (e.g. desired well trajectory 304 in FIG. 3A or adjusted well trajectory 350*b* in FIG. 3B) can be determined based on the desired distance to the oil-water contact. Using the desired or adjusted well trajectory a target point (e.g. projected point 316 in FIG. 3A or adjusted setpoint 370*b* in FIG. 3B) can be defined that may be related (e.g. close to or on) the desired well trajectory. Determination of the projected oil-water contact area 302 may be based at least in part on the one or more distances to oil-water contact. For example, an extrapolation of one a more oil-water contact positions, such as a polynomial with polynome coefficients (e.g. a linear regression with a slope and an offset value) may be calculated along a defined interval length. The location points (e.g. location points 312*a*-312*e* in FIG. 3A or I-IV in FIG. 3B) that are used for the extrapolation may begin with a most recent (newest) location point (e.g., the location point 312*a* in FIG. 3A or location point I in FIG. 3B) of detected oil-water contact and may work backwards a defined number of location points, such as 3 location points, 5 location points, more than 10 location points, more than 20 location points, etc. (e.g., one or more of the location points 312*b*, 312*c*, 312*d*, 312*e* in FIG. 3A or one or more of location points II, II, IV in FIG. 3B). This enables taking into account a most recent location point while accounting for differences over the defined number of location points. Using the extrapolation parameters, such as the polynome coefficients (e.g. slope and offset), a projected point may be determined as: projected point=(projected position of projected point)* (regression slope)+(offset value).

At block 408, the processing system 12 and/or downhole electronic components 9 adjusts a trajectory of a bottom hole assembly (e.g., the BHA 13) disposed in the wellbore based at least in part on the projected oil-water contact and the desired well trajectory. For example, when an oil-water contact predicted dip and distance from the drill bit is calculated, one or more downlink commands are sent. These commands are steering instructions, which are calculated and will align the well with a desired TVD and dip amount. In examples, the current position of the BHA 13 is known from a directional survey; similarly, a forward calculated distance to the drill bit 7 from the measurement point 310 is also known. A desired (i.e., goal) inclination and desired (i.e., goal) vertical change from the current position of the BHA 13 is also known. Using this known information, a distance required and an intermediate inclination in order to get to the goal inclination having achieved the desired vertical change within given dogleg constraints can be determined.

This is achieved iteratively using increasing intermediate point (i.e., the intermediate point 314), and inclination changes can be implemented and vertical change can be calculated to the intermediate point for adding vertical displacement. If a total vertical change equals a desired vertical change, then the intermediate point and the final point data are reported; if not, calculations are repeated with increasing intermediate inclination changes.

The downlink commands can then be sent by the processing system 12 and/or downhole electronic components 9 to adjust the trajectory of the BHA 13 so that the wellbore can be drilled to maintain the desired distance 308 between the BHA 13 and the oil-water contact area or line 302. The desired distance 308 can be based on the oil-water contact as well as true vertical depth survey data.

Additional processes also may be included, and it should be understood that the process depicted in FIG. 4 represents an illustration, and that other processes may be added or existing processes may be removed, modified, or rearranged without departing from the scope of the present disclosure.

Example embodiments of the disclosure include or yield various technical features, technical effects, and/or improvements to technology. Example embodiments of the disclosure provide technical solutions for automated geosteering based on a distance to a formation boundary. These technical solutions collect an analyze large volumes of electromagnetic data collected in wellbore by a measurement device disposed in a bottom hole assembly, then perform an inversion on such data in real-time or near-real-time to determine a projected point to steer the BHA based on a one or more distances to the formation boundary, which is based on the inversion. The large volume of data, complexity of the performing inversion and determining the projected point, and the real-time or near-real-time nature of adjusting the trajectory of the bottom hole assembly cannot practically be performed in the human mind. Thus, the techniques described herein represent an improvement to geosteering technologies. Accordingly, drilling decisions can be made more accurately and faster, thus improving drilling efficiency, reducing non-production time, improving hydrocarbon recovery, and the like. Specifically, geosteering is improved by acquiring and maintaining a desired distance between the bottom hole assembly during drilling and a formation boundary area or line. This increases hydrocarbon recovery from a hydrocarbon reservoir compared to conventional techniques.

Set forth below are some embodiments of the foregoing disclosure:

Embodiment 1: A method for performing automated geosteering, the method comprising: receiving, by a processing system, formation evaluation data from a bottom hole assembly disposed in a wellbore; determining, by the processing system, position data of a formation boundary from the formation evaluation data; extrapolating, by the processing system, the position data to generate extrapolated position data of the formation boundary; and adjusting a trajectory of the wellbore based at least in part on the extrapolated position data of the formation boundary.

Embodiment 2: A method according to any prior embodiment, wherein the extrapolated position data is determined with a polynomial.

Embodiment 3: A method according to any prior embodiment, wherein the position data of the formation boundary is determined at least partially based on directional data.

Embodiment 4: A method according to any prior embodiment, wherein the directional data is at least one of an inclination of a portion of the bottom hole assembly, an azimuth of a portion of the bottom hole assembly, and a toolface angle of a direction in which the formation boundary is located.

Embodiment 5: A method according to any prior embodiment, wherein the trajectory is adjusted at least partially based on a predefined threshold of a distance between the adjusted trajectory and the formation boundary.

Embodiment 6: A method according to any prior embodiment, further comprising: filtering, by the processing system, the formation evaluation data to generate filtered formation evaluation data; and determining, by the processing system, the position data of the formation boundary from the filtered formation evaluation data.

Embodiment 7: A method according to any prior embodiment, wherein the formation evaluation data is generated at two or more positions within in the wellbore.

Embodiment 8: A method according to any prior embodiment, wherein adjusting the trajectory comprises adjusting a setpoint for a control process to steer the bottom hole assembly.

Embodiment 9: A method according to any prior embodiment, wherein the position data is at least one of a distance from the formation boundary to the bottom hole assembly, and a true vertical depth of the formation boundary.

Embodiment 10: A method according to any prior embodiment, wherein the extrapolated position data is determined based on measured depth.

Embodiment 11. A system for preforming automated geosteering of a wellbore, the system comprising: a bottom hole assembly disposed in the wellbore; and a processing system for executing computer readable instructions, the computer readable instructions controlling the processing system to perform operations comprising: receiving, by the processing system, formation evaluation data from the bottom hole assembly disposed in the wellbore; determining, by the processing system, position data of a formation boundary from the formation evaluation data; extrapolating, by the processing system, the position data to generate extrapolated position data of the formation boundary; and adjusting a trajectory of the wellbore based at least in part on the extrapolated position data of the formation boundary.

Embodiment 12: A system according to any prior embodiment, wherein the extrapolated position data is determined with a polynomial.

Embodiment 13: A system according to any prior embodiment, wherein the position data of the formation boundary is determined at least partially based on directional data.

Embodiment 14: A system according to any prior embodiment, wherein the directional data is at least one of an inclination of a portion of the bottom hole assembly, an azimuth of a portion of the bottom hole assembly, and a toolface angle of a direction in which the formation boundary is located.

Embodiment 15: A system according to any prior embodiment, wherein the trajectory is adjusted at least partially based on a predefined threshold of a distance between the adjusted trajectory and the formation boundary.

Embodiment 16: A system according to any prior embodiment, wherein the processing system is further configured to perform operations comprising: filtering, by the processing system, the formation evaluation data to generate filtered formation evaluation data; and determining, by the processing system, the position data of the formation boundary from the filtered formation evaluation data.

Embodiment 17: A system according to any prior embodiment, wherein the formation evaluation data is generated at two or more positions within in the wellbore.

Embodiment 18: A system according to any prior embodiment, wherein adjusting the trajectory comprises adjusting a setpoint for a control process to steer the bottom hole assembly.

Embodiment 19: A system according to any prior embodiment, wherein the position data is at least one of a distance from the formation boundary to the bottom hole assembly, and a true vertical depth of the formation boundary.

Embodiment 20: A system according to any prior embodiment, wherein the extrapolated position data is determined based on measured depth.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A method for performing automated geosteering, the method comprising:

receiving, by a processing system, first formation evaluation data from a bottom hole assembly disposed in a wellbore at a first data point and second formation evaluation data from the bottom hole assembly disposed in the wellbore at a second data point;

determining, by the processing system, a first position data of a formation boundary from the first formation evaluation data at the first data point and a second position data of the formation boundary from the second formation evaluation data at the second data point;

determining a first sphere from the first data point and the first position data;

determining a second sphere from the second data point and the second position data;

determining a location point of the formation boundary on a section of the first sphere that is not included in the second sphere;

extrapolating, by the processing system, the location point to generate extrapolated position data of the formation boundary; and maintaining a distance between the bottom hole assembly and the formation boundary by adjusting a trajectory of the wellbore, the adjusting comprising transmitting steering commands to a steering tool to steer the bottom hole assembly, the adjusting based at least in part on the extrapolated position data of the formation boundary.

2. The method of claim 1, wherein the extrapolated position data is determined with a polynomial.

3. The method of claim 2, wherein the extrapolated position data is determined based on measured depth.

4. The method of claim 1, wherein the extrapolated position data of the formation boundary is along a planned trajectory of the wellbore.

5. The method of claim 1, wherein the extrapolated position data of the formation boundary is determined at least partially based on directional data.

6. The method of claim 5, wherein the directional data is at least one of an inclination of a portion of the bottom hole assembly, an azimuth of the portion of the bottom hole assembly, or a toolface angle of a direction in which the formation boundary is located.

7. The method of claim 1, wherein the trajectory is adjusted at least partially based on a predefined threshold of a distance between the adjusted trajectory and the formation boundary.

8. The method of claim 1, further comprising:

filtering, by the processing system, at least one of the first formation evaluation data or the second formation evaluation data to generate filtered formation evaluation data; and determining, by the processing system, the location point of the formation boundary from the filtered formation evaluation data.

9. The method of claim 1, wherein adjusting the trajectory comprises adjusting a setpoint for a control process to steer the bottom hole assembly.

10. The method of claim 1, wherein at least one of the first distance or the second distance is at least one of a distance from the bottom hole assembly to the formation boundary, or a true vertical depth of the formation boundary.

11. A system for performing automated geosteering of a wellbore, the system comprising:

a bottom hole assembly disposed in the wellbore; and a processing system for executing computer readable instructions, the computer readable instructions controlling the processing system to perform operations comprising:

receiving, by the processing system, first formation evaluation data from the bottom hole assembly disposed in the wellbore at a first data point and second formation evaluation data from the bottom hole assembly disposed in the wellbore at a second data point;

determining, by the processing system, a first postion data of a formation boundary from the formation evaluation data at the first data point and a second position data of the formation boundary from the formation evaluation data at the second data point;

determining a first sphere from the first data point and the first position data;

determining a second sphere from the second data point and the second positon data;

determining a location point of the formation boundary on a section of the first sphere that is not included in the second sphere;

extrapolating, by the processing system, the location point to generate extrapolated position data of the formation boundary; and maintaining a distance between the bottom hole assembly and the formation boundary by adjusting a trajectory of the wellbore, the adjusting comprising transmitting steering commands to a steering tool to steer the bottom hole assembly, the adjusting based at least in part on the extrapolated position data of the formation boundary.

12. The system of claim 11, wherein the extrapolated position data is determined with a polynomial.

13. The system of claim 12, wherein the extrapolated position data is determined based on measured depth.

14. The system of claim 11, wherein the extrapolated position data of the formation boundary is determined at least partially based on directional data.

15. The system of claim 14, wherein the directional data is at least one of an inclination of a portion of the bottom hole assembly, an azimuth of the portion of the bottom hole assembly, or a toolface angle of a direction in which the formation boundary is located.

16. The system of claim 11, wherein the trajectory is adjusted at least partially based on a predefined threshold of a distance between the adjusted trajectory and the formation boundary.

17. The system of claim 11, wherein the processing system is further configured to perform additional operations comprising:

filtering, by the processing system, at least one of the first formation evaluation data or the second formation evaluation data to generate filtered formation evaluation data; and determining, by the processing system, the location point of the formation boundary from the filtered formation evaluation data.

18. The system of claim 11, wherein adjusting the trajectory comprises adjusting a setpoint for a control process to steer the bottom hole assembly.

19. The system of claim 11, wherein at least one of the first distance or the second distance is at least one of a distance from the bottom hole assembly to the formation boundary, or a true vertical depth of the formation boundary.

20. The system of claim 11, wherein the computer readable instructions further controls the processing system to generate the extrapolated position data of the formation boundary along a planned trajectory of the wellbore.

* * * * *